United States Patent [19]

Linger

[11] 4,162,005

[45] Jul. 24, 1979

[54] ARTIST BRUSH BOX

[76] Inventor: Harrison K. Linger, 7412 Springvale Dr., Louisville, Ky. 40222

[21] Appl. No.: 859,444

[22] Filed: Dec. 12, 1977

[51] Int. Cl.[2] ..... A46B 17/00; B65D 77/26

[52] U.S. Cl. ..... 206/362; 206/379; 206/1.7

[58] Field of Search ..... 206/372, 362, 15.2, 206/15.3, 379, 486, 1.7; 224/45 AB, 45 BA; 211/69.9

[56] References Cited

U.S. PATENT DOCUMENTS

| | | | |
|---|---|---|---|
| 305,544 | 9/1884 | Stirrup | 206/1.7 |
| 1,446,741 | 2/1923 | Faber | 206/1.7 |
| 1,585,498 | 5/1926 | Kenyon | 206/486 |
| 2,987,192 | 6/1961 | Metzler | 211/69.9 |
| 3,236,366 | 2/1966 | Broda | 206/379 |
| 3,426,890 | 2/1969 | Bayer | 206/379 |

*Primary Examiner*—Herbert F. Ross
*Attorney, Agent, or Firm*—Ronald A. Sandler

[57] ABSTRACT

A box for artist brushes is integrally molded of plastic and includes two elongated panels hingedly interconnected for movement between open and closed conditions, each panel having one end wall, one side wall and one latch flange arranged complementary with those members on the other panel for cooperation therewith to form a closed container in the closed configuration of the panels, while facilitating insertion of brushes when opened. Each panel includes a transverse support bridge and two transverse rails longitudinally spaced apart adjacent to one end of the panel. Each bridge includes two inclined upwardly converging walls interconnected by a top wall which slopes downwardly from one side of the panel to the other, each inclined wall being provided with a row of holes therethrough decreasing in size from the high end to the low end of the bridge. Each hole is aligned with a like-sized hole in the other inclined wall for receiving a brush handle therethrough and is shaped and dimensioned resiliently to grip the brush handle. The rails serve to tilt long, thin handles to engage them in oversized holes.

The support bridges and rails are arranged on the panels to facilitate nesting thereof and the brushes held thereby when the box is closed.

10 Claims, 24 Drawing Figures

FIG. 1
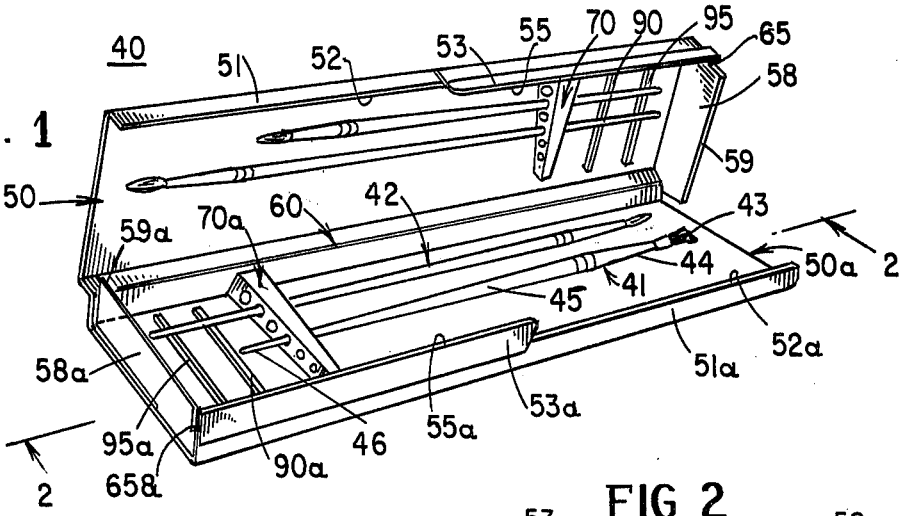
FIG. 2
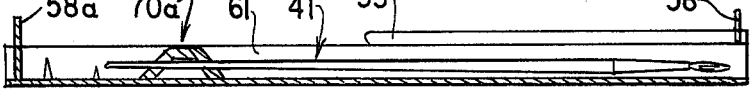
FIG. 3
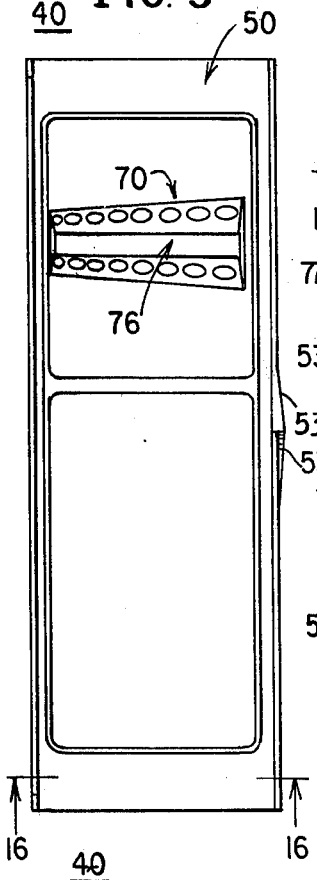
FIG. 5
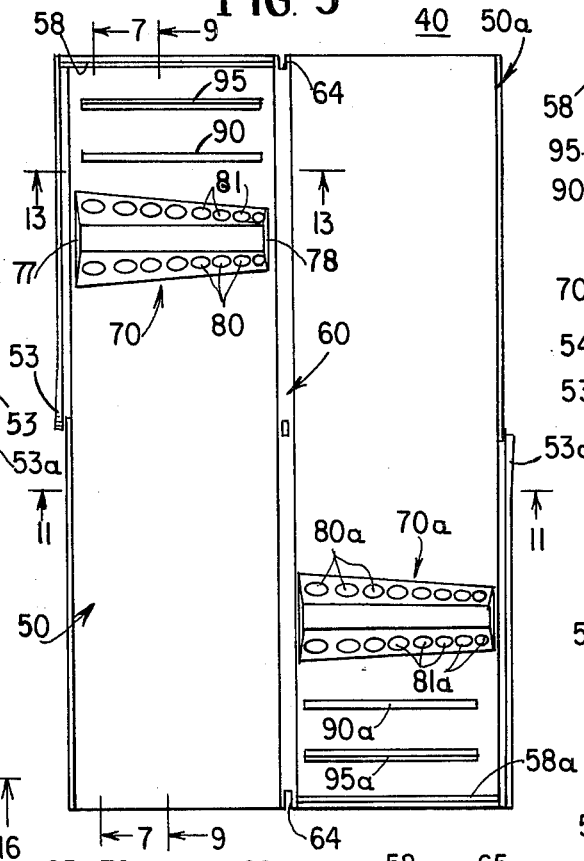
FIG. 7
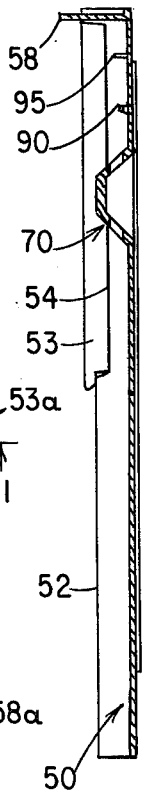
FIG. 8
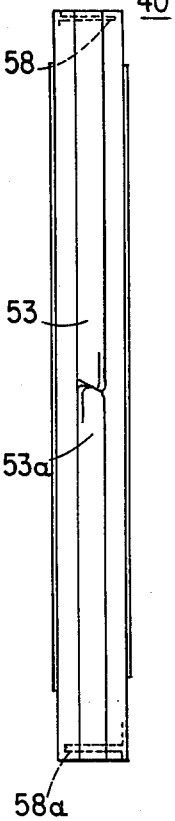
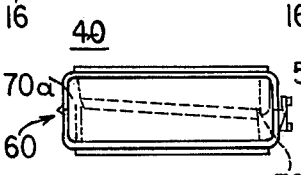
FIG. 4
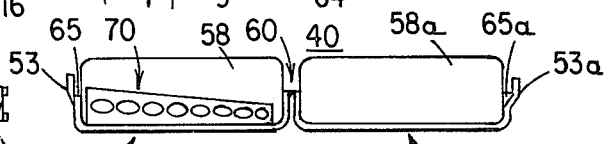
FIG. 6

ARTIST BRUSH BOX

BACKGROUND OF THE INVENTION AND PRIOR ART STATEMENT

The present invention relates to a container for storing and transporting artist brushes of all types and sizes.

Most artist brushes have round handles which taper down from the widest diameter at the ferrule which holds the bristles to a small diameter tip end. Some brushes with long handles measure up to fourteen inches in overall length, while the short-handled brushes may measure approximately seven inches in overall length. Most artist brushes are very expensive and require careful handling to protect the bristles from being jammed or ruffled within a container. There is a need for a container which permits artist brushes of varied types and sizes to be stored without interference with one another, while accommodating easy insertion and removal of the brushes. Applicant is aware of no such container in the prior art.

Display cards or the like for supporting and displaying elongated articles such as pencils, crayons or the like by inserting them through aligned openings in inclined walls of a supporting bridge are disclosed, for example, in the following U.S. Pat. Nos. 689,667, issued to E. E. Blakeslee on Dec. 24, 1901; 1,176,786, issued to J. Stranders on Mar. 28, 1916; 1,446,741, issued to L. W. Faber on Feb. 27, 1923; 1,693,591, issued to G. E. Chatillon on Dec. 4, 1928; 1,887,145, issued to H. A. Allendorf on Nov. 8, 1932; and 2,024,984 issued to I. C. Bradley on Dec. 17, 1935. None of these devices is a container, and each is designed for holding only a single size of article.

Similar support devices in the form of a container are disclosed in U.S. Pat. No. 1,381,487, issued to S. P. Maruny et al. on June 14, 1921 and U.S. Pat. No. 1,913,105 issued to G. B. Case et al. on June 6, 1933. But in these latter devices also, each holder is designed for accommodating a single size or type of article.

None of these prior art devices is suitable for carrying artist brushes, let alone different sizes and types thereof. Copies of each of the aforementioned patents are filed herewith.

SUMMARY OF THE INVENTION

It is a general object of the present invention to provide a container for storing and transporting different types and sizes of artist brushes without danger of the bristles being damaged.

More particularly, it is an object of this invention to provide an artist brush holder which is of simple and economical construction and which is designed to facilitate insertion and removal of artist brushes.

It is another object of this invention to provide a holder of the type set forth which readily accommodates varying sizes and types of artist brushes without interference among the brushes.

It is another object of this invention to provide a holder of the type set forth, which securely holds the brushes in place, while permitting ready insertion and removal thereof and facilitating adjustment of the position of the brush in the holder.

Still another object of the invention is the provision of a container comprising two holders of the type set forth, hingedly interconnected for opening and closing the container.

Yet another object of the invention is the provision of a container of the type set forth which affords access to the brushes stored therein when the container is closed.

In summary, these objects are attained in the present invention by providing a holder for artist brushes having elongated tapered handles circular in transverse cross section, the holder comprising an elongated panel, a support member on the panel extending transversely thereof and including two inclined walls spaced apart longitudinally of the panel and disposed at predetermined angles with respect thereto, the walls respectively having like-sized holes therethrough having the centers thereof lying along a common axis extending longitudinally of the panel substantially parallel thereto, the holes being adapted to receive therethrough a brush handle of a predetermined size until the peripheral edges of the holes engage the handle firmly to hold it in place with the handle tip disposed at a predetermined location rearwardly of the support member, a first rail on the panel disposed rearwardly of the predetermined location and substantially parallel to the support member and extending a short distance above the lower ends of the holes, and a second rail on the panel spaced rearwardly from the first rail and parallel thereto and extending thereabove, each of the first and second rails being engageable with a brush handle smaller than the predetermined size for elevating the handle and inclining it with respect to the axis to urge the handle into engagement with the peripheral edges of the holes before the handle extends beyond the adjacent end of the panel, whereby different size handles can be held by the support member within the confines of the panel.

Further features of the invention pertain to the particular arrangement of the parts of the artist brush holder whereby the above-outlined and additional operating features thereof are attained.

The invention, both as to its organization and method of operation, together with further objects and advantages thereof will best be understood by reference to the following specification taken in connection with the accompanying drawings.

BRIEF DESCRIPTION OF THE DRAWINGS

FIG. 1 is a perspective view of an artist brush box constructed in accordance with and embodying the features of the present invention, illustrated in a partially open configuration;

FIG. 2 is a view in vertical section taken along the line 2—2 in FIG. 1, but with the brush box disposed in a fully open configuration;

FIG. 3 is a top plan view of the brush box of FIG. 1 in its closed configuration;

FIG. 4 is an end elevational view of the brush box illustrated in FIG. 3;

FIG. 5 is a top plan view of the brush box of FIG. 1 in its fully open configuration;

FIG. 6 is an end elevational view of the brush box as illustrated in FIG. 5;

FIG. 7 is a view in vertical section taken along the line 7—7 in FIG. 5;

FIG. 8 is a side elevational view of the brush box illustrated in FIG. 3, as viewed from the right-hand side thereof;

DESCRIPTION OF THE PREFERRED EMBODIMENT

Figure 9:
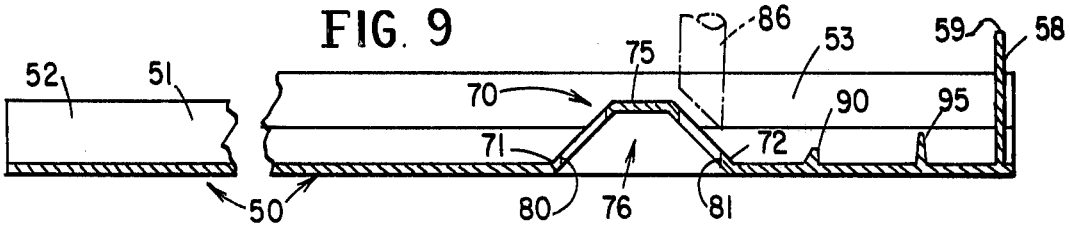
FIG. 9 is an enlarged fragmentary view in vertical section taken along the line 9—9 in FIG. 5.

Referring first to FIGS. 1 through 8 of the drawings, there is illustrated an artist brush box, generally designated by the numeral 40, constructed in accordance with and embodying the features of the present invention. The brush box 40 is designed for securely holding therein a plurality of artist brushes, such as brushes 41 and 42, of different sizes and types, each brush including a group of bristles 43 held in place by a ferrule 44 on an elongated handle 45 which is tapered toward a tip 46, the handle 45 being substantially circular in transverse cross section.

The brush box 40 is preferably integrally molded of a single piece of material such as plastic and includes two elongated flat rectangular panels 50 and 50*a* coupled together along one side thereof by a hinge interconnection, generally designated by the numeral 60, to accommodate hinged movement of the panels 50 and 50*a* between a fully open condition illustrated in FIGS. 5 and 6 and a closed condition illustrated in FIGS. 3 and 4. The panels 50 and 50*a* are constructed complementary to each other so that, in the closed condition thereof, they cooperate to form a closed container. More particularly, the panels 50 and 50*a* are substantially identical in size and shape and are hingedly interconnected with the ends thereof substantially flush with each other.

The panel 50 includes an outer side wall 51 extending upwardly therefrom substantially normal thereto along the entire length of the outer edge thereof. The upper edge of the outer side wall 51 is stepped midway between the ends thereof to form a high portion 52 and a low portion 54. Formed integrally with the outer side wall 51 and extending outwardly therefrom and upwardly thereabove is an elongated curved flange 53 which extends longitudinally the entire length of the low portion 54 of the outer side wall 51, and is provided with a horizontal upper edge 55. The inner end of the flange 53 terminates in a rounded tip 56 and a straight end surface 57 which slants downwardly back toward the outer end of the flange 53. At the end of the panel 50 at which the flange 53 terminates, the panel 50 is also provided with a rectangular end wall 58 which extends upwardly therefrom substantially normal thereto to a horizontal upper edge 59 a predetermined distance above the upper edge 55 of the flange 53.

In like manner, the panel 50*a* includes an outer side wall 51*a* extending upwardly therefrom substantially normal thereto along the entire length of the outer edge thereof. The upper edge of the outer side wall 51*a* is stepped midway between the ends thereof to form a high portion 52*a* and a low portion 54*a*. Formed integrally with the outer side wall 51*a* and extending outwardly therefrom and upwardly thereabove is an elongated curved flange 53*a* which extends longitudinally the entire length of the low portion 54*a* of the outer side wall 51*a*, and is provided with a horizontal upper edge 55*a*. The inner end of the flange 53*a* terminates in a rounded tip 56*a* and a straight end surface 57*a* which slants downwardly back toward the outer end of the flange 53*a*. At the end of the panel 50*a* at which the flange 53*a* terminates, the panel 50*a* is also provided with a rectangular end wall 58*a* which extends upwardly therefrom substantially normal thereto to a horizontal upper edge 59*a* a predetermined distance above the upper edge 55*a* of the flange 53.

Figure 11:
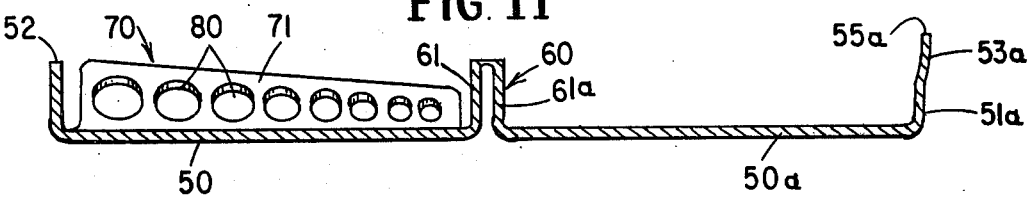
FIG. 11 is an enlarged view in vertical section taken along the line 11—11 in FIG. 5.
Figure 12:
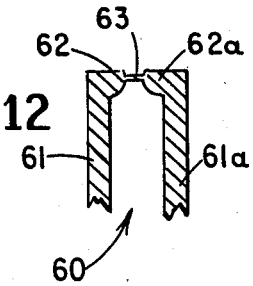
FIG. 12 is a further enlarged fragmentary view in vertical section of the hinge interconnection between the panels of FIG. 11.
Figure 13:
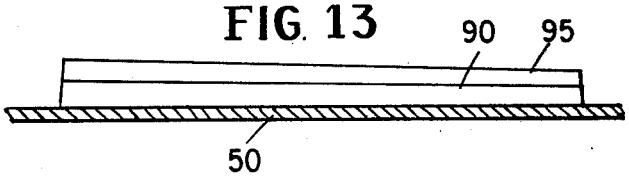
FIG. 13 is an enlarged fragmentary view in vertical section taken along the line 13—13 in FIG. 5.

Referring also to FIGS. 11 and 12 of the drawings, the hinge interconnection 60 between the panels 50 and 50*a* includes a pair of longitudinally extending hinge walls 61 and 61*a* respectively integral with and extending upwardly from the panels 50 and 50*a* substantially normal thereto along the entire length of the inner edges thereof. The hinge walls 61 and 61*a* are respectively integral along the entire lengths thereof at the upper edges thereof with inwardly extending short hinge tabs 62 and 62*a*, which are interconnected along the entire lengths thereof by a thin hinge membrane 63. Preferably, the membrane 63 is notched at the opposite ends thereof, as at 64 (see FIG. 5). The upper edges of the hinge tabs 62 and 62*a* are respectively substantially coplanar with the upper edges of the high portions 52 and 52*a* of the outer side walls 51 and 51*a*.

In use, the brush box 40 is hingedly movable between a fully open condition illustrated in FIGS. 5, 6 and 11, wherein the panels 50 and 50*a* are substantially coplanar, and a fully closed condition, illustrated in FIGS, 3, 4 and 8, wherein the panel 50 overlies the panel 50*a* and is substantially parallel thereto. More particularly, it will be noted that the members 51, 53 and 58 are respectively arranged complementary to the members 51*a*, 53*a* and 58*a* for cooperation with each other and with the panels 50 and 50*a* and the hinge walls 61 and 61*a* to form a closed container when the brush box 40 is disposed in its closed configuration. In this regard, it will be noted that the end walls 58 and 58*a* are respectively provided with notches 65 and 65*a* in the upper edges thereof at the outer ends thereof.

Figure 15:
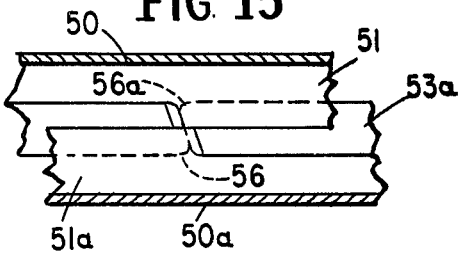
FIG. 15 is a view similar to FIG. 14, and illustrating the parts in their latched configuration.
Figure 14:
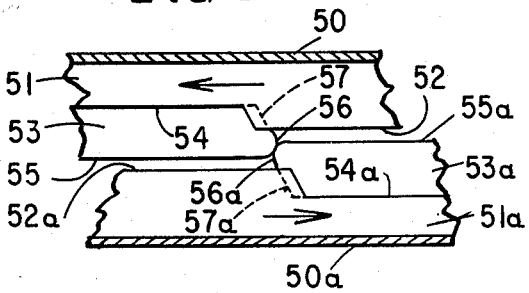
FIG. 14 is an enlarged fragmentary view in vertical section of the latch portions of the outer side walls of the brush box, as viewed from the inside thereof, and illustrating the movement thereof to the latching configuration.
Figure 16:
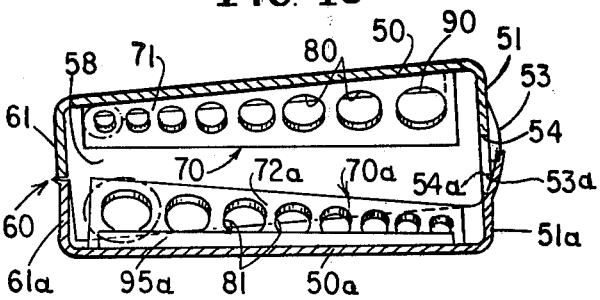
FIG. 16 is an enlarged view in vertical section taken along the line 16—16 in FIG. 3, but illustrating the parts in the nearly closed configuration shown in FIG. 14.

Thus, referring also to FIGS. 14, 15 and 16, as the brush box 40 is moved to its closed configuration, the rounded tips 56 and 56*a* of the flanges 53 and 53*a* engage each other as in FIG. 14, the hinge interconnection 60 accommodating a flexing movement of the panels 50 and 50*a* in the direction of the arrows in FIG. 14 to permit a camming action of the rounded tips 56 and 56*a* past each other to bring the slanted ends 57 and 57*a* into sliding abutting engagement with each other and to slide with respect to each other to bring the panels 50 and 50*a* into the fully closed configuration illustrated in FIG. 15. In this closed configuration, the engagement of the slanted ends 57 and 57*a* serves securely to latch the brush box 40 closed. Reopening of the brush box 40 is accomplished by using the thumb and fingers to apply opposing force in the direction of the arrows in FIG. 14 anywhere along the opposite facing edge surfaces of the outer side walls 51 and 51*a* to slide the slanted ends 57 and 57*a* along each other back to the position illustrated in FIG. 14.

It will also be appreciated that when the brush box 40 is in its closed configuration, the upper edges of the high portions 52 and 52*a* of the outer side walls 51 and 51*a* adjacent to the steps therein are disposed in abutting engagement with each other, and are respectively overlapped by the opposed flanges 53*a* and 53, while the upper surfaces of the hinge tabs 62 and 62*a* abut each other, as indicated in FIG. 16. This overlapping arrangement of the flanges 53 and 53*a* with the outer side walls 51*a* and 51 keeps the slanted ends 57 and 57*a* of the flanges 53 and 53*a* from spreading inwardly or outwardly and, thereby, maintains a positive contact therebetween as they slide between the open and closed conditions thereof. The end walls 58 and 58*a* respectively engage the inner surfaces of the panels 50*a* and 50 to close the ends of the brush box 40, with the outer side walls 51 and 51*a* respectively being accommodated in the notches 65*a* and 65.

The panels 50 and 50*a* are respectively provided with support bridges, respectively generally designated by the numerals 70 and 70*a*, which are substantially identical in construction, and differ only in position and orientation, wherefore only the support bridge 70 will be described in detail, it being understood that like parts on the support bridge 70*a* will have the same reference numerals, followed by the suffix "a."

Figure 10:
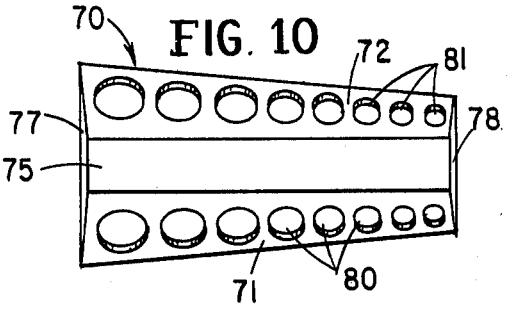
FIG. 10 is an enlarged top plan view of the support bridge illustrated in the upper portion of FIG. 5.

Referring now also to FIGS. 9 and 10, the support bridge 70 extends transversely of the panel 50 approximately midway between the ends of the flange 53, and includes a pair of upwardly converging inclined transverse walls 71 and 72 which are each preferably inclined at the same angle with respect to the panel 50, but are higher at the outer ends thereof than at the inner ends thereof, whereby the lower edges of the inclined walls 71 and 72 are spaced farther apart at the outer ends thereof than at the inner ends thereof. The inclined walls 71 and 72 are interconnected at the upper ends thereof by a flat rectangular top wall 75 which slopes downwardly from the outer to the inner end thereof. The adjacent ends of the walls 71, 72 and 75 are interconnected and closed by sloping end walls 77 and 78 (see FIG. 10). The inclined walls 71 and 72 and the end walls 77 and 78 are all integral with the panel 50 and cooperate to surround a trapezoidal aperture therein to form a well 76 (see FIG. 9) on the outer side of the panel 50.

Figures 17, 17A, 18, 18A, 19, 19A, 20, 21:
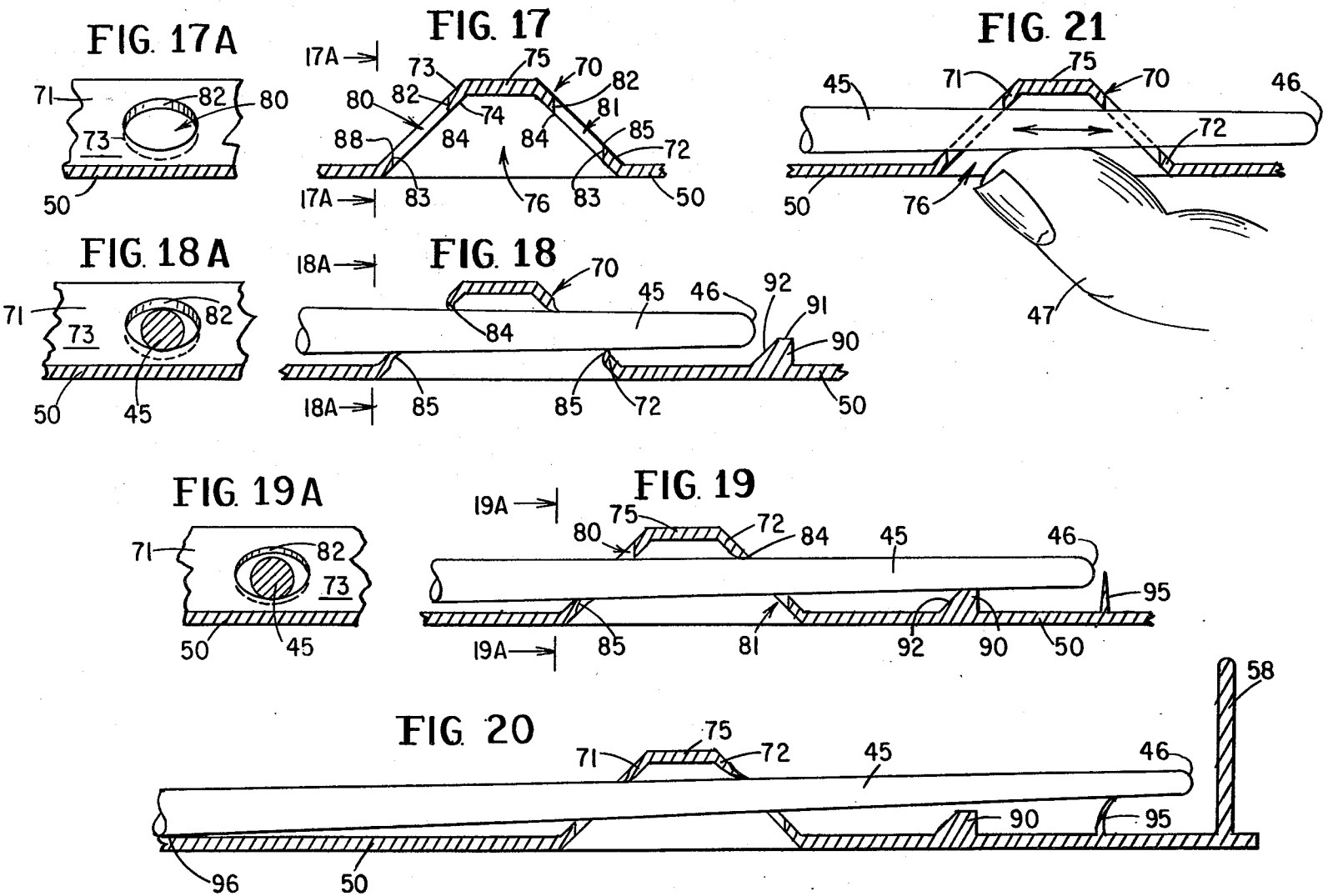
FIG. 17 is a further enlarged vertical sectional view of the support bridge portion of FIG. 9.
FIG. 17A is a fragmentary view in vertical section taken along the line 17A—17A in FIG. 17.
FIG. 18 is a view similar to FIG. 17, but including the rigid rail and illustrating a brush handle held in position in the support bridge.
FIG. 18A is a view in vertical section taken along the line 18A—18A in FIG. 18.
FIG. 19 is a view similar to FIG. 18, but also including the flexible rail, and illustrating a smaller diameter brush handle securely held in the support bridge with the assistance of the rigid rail.
FIG. 19A is a view in vertical section taken along the line 19A—19A in FIG. 19.
FIG. 20 is a view similar to FIG. 19, and further including the panel end wall, and illustrating a still smaller diameter brush handle held in the support bridge with the assistance of the flexible rail.
FIG. 21 is a view similar to FIG. 17, and illustrating the method of manual adjustment of the position of a brush handle in the support bridge from outside the brush box.

Referring also to FIGS. 17 and 17A of the drawings, each of the inclined walls 71 and 72 has an inner surface 73 and an outer surface 74 separated by the predetermined thickness of the wall. The walls 71 and 72 respectively have formed therein rows of different sized holes 80 and 81, each row of holes decreasing in size from the high end of the support bridge 70 to the low end thereof. Each of the holes 80 is aligned with a substantially identically-sized hole 81 to form a pair of holes having the centers thereof lying along an axis disposed substantially parallel to the panel 50. Preferably the forward hole 80 is slightly larger than the rear hole 81.

Preferably, each of the inclined walls 71 and 72 is inclined at an angle of forty-five degrees to the panel 50. In molding of the brush box 40, the holes 80 and 81 are molded around cylindrical core pins which are disposed perpendicular to the panel 50 and have forty-five degree shutoff faces coplanar with the outer surfaces 74 of the inclined walls 71 and 72. Such a core pin is diagrammatically illustrated in FIG. 9 and is designated by the numeral 86. Thus, each of the holes 80 and 81 is generally elliptical in shape, as viewed in a direction parallel to the panel 50 (see FIG. 17A) and is defined by generally crescent-shaped upper and lower vertical surfaces 82 and 83. The upper vertical surface 82 intersects the outer surface 74 of the inclined wall 71 or 72 to form a sharp flexible upper edge 84, while the lower vertical surface 83 intersects the inner surface 73 of the inclined wall 71 or 72 to form a sharp flexible lower edge 85.

The support bridge 70*a* is disposed on the panel 50*a* and extends transversely thereof approximately midway between the ends of the flange 53*a*, but is positioned to slope downwardly from the inner side to the outer side of the panel 50*a* (see FIGS. 1 and 5).

The panel 50 is also provided with an elongated rigid rail 90 extending transversely thereof and spaced from the support bridge 70 in the direction of the end wall 58. Referring also to FIGS. 13 and 18 through 20 of the drawings, the rail 90 has a flat upper surface 91 and an inclined front surface 92 facing the support bridge 70. The upper surface 91 is disposed a slight distance above the bottoms of the holes 81 in the support bridge 70, and slopes downwardly from the outer side to the inner side of the panel 50, in the same manner as does the support bridge 70.

The panel 50 also includes an elongated thin flexible rail 95 extending transversely of the panel 50 and disposed approximately midway between the rail 90 and the end wall 58. The rail 95 extends a predetermined distance above the upper surface 91 of the rail 90 and has a sharp upper edge which is inclined downwardly from the outer side to the inner side of the panel 50.

Rails 90*a* and 95*a*, respectively identical in construction to the rails 90 and 95, are provided on the panel 50*a*, and are oriented so that their relationship to the support bridge 70*a* is the same as the relationship of the rails 90 and 95 to the support bridge 70.

Referring now also to FIG. 21 of the drawings, the use and function of the brush box 40 will be described in detail. When the brush box 40 is disposed in the fully open configuration thereof, it will be noted that each of the panels 50 and 50*a* has a front or open end and a rear or closed end. The mounting of artist brushes 41, 42 in the brush box 40 is substantially identical with respect to both of the panels 50 and 50*a*, wherefore in describing this procedure only the panel 50 and the parts thereof will be referred to.

The tip 46 of a brush handle 45 is inserted through a pair of holes 80 and 81 in the support bridge 70 from the front side to the rear side thereof, this insertion being facilitated by the open end of the panel 50. The brush handle 45 is pushed through the holes 80 and 81 until it is firmly and resiliently engaged by the sharp flexible edges 84 and 85 of the holes, as illustrated in FIG. 18, this engagement serving to flex the edges 84 and 85, slightly to expand the opening and yet firmly and resiliently to grip the brush handle 45 without damage thereto.

Referring to FIG. 18A, it will be noted that by reason of the elliptical shape of the holes 80 and 81, they engage the brush handle 45 only along the upper and lower surfaces thereof, the spaces between the brush handle 45 and the sides of the holes 80 and 81 permitting slight lateral movement of the brush handle 45 to facilitate placement thereof in the brush box 40 with respect to adjacent brushes, and to permit some vertical expansion of the holes 80 and 81 as the brush handle 45 is tightened therein. This slight lateral movement also facilitates insertion of the fingers into the box between the brush handles to ease removal of the brushes from the brush box 40.

Normally, the user will attempt to select a pair of holes 80 and 81 of a size such that the brush handle 45 can be firmly engaged therein without the brush handle tip 46 engaging the rail 91, and with the bristles 43 not extending beyond the open end of the panel 50. But is is an important feature of the present invention that if the brush handle 45 is too long to permit this preferred mounting arrangement, or if the user has a number of brushes of the same size, the brushes can be mounted in oversized pairs of the holes 80 and 81. This will normally require that the brush handle 45 be pushed a greater distance through the holes 80 and 81 and toward the end wall 58 until a thick enough portion of the tapered brush handle 45 is disposed in the support bridge 70 for firm engagement thereby.

Since the distance that the brush handle tip 46 can be extended rearwardly beyond the support bridge 70 is limited by the end wall 58, the rails 90 and 95 serve to permit firm engagement of a relatively thin brush handle 45 in the support bridge 70, even though the diameter of the brush handle 45 at the point of engagement is less than the vertical dimensions of the holes 80 and 81. Thus, referring to FIGS. 19 through 20, as the brush handle tip 46 moves rearwardly, it will engage the inclined front surface 92 of the rail 90 and ride upwardly therealong and over the top of the rail 90. This upward deflection of the tip end of the brush handle 45 will incline it at a slight angle to the panel 50 and cause it to engage the sharp flexible lower edge 85 of the hole 80 and the sharp flexible upper edge 84 of the hole 81, as illustrated in FIG. 19, thereby securely to grip the brush handle 45 in the support bridge 70. Preferably, the height of the rail 90 is such as to be slightly lower than the center of the average brush handle tip 46 to be inserted through the adjacent pair of openings 80 and 81, to facilitate sliding of the brush handle 45 upwardly over the rail 90.

The flexible rail 95 permits the mounting of still thinner brush handles 45 in a given pair of holes 80 and 81. Thus, if, when the brush handle 45 rests upon the rigid rail 90, it still does not engage the peripheral edges of the holes 80 and 81, it is pushed further rearwardly until it rides up on and over the flexible rail 95, which inclines the brush handle 45 at a still greater angle to the panel 50, moving it into engagement with the sharp flexible upper edge 84 of the hole 81. The point 96 of forward contact of the brush handle 45 may either be at the sharp flexible lower edge 85 of the hole 80 or along the panel 50 forwardly of the support bridge 70, depending upon the diameter and length of the brush handle 45, as illustrated in FIG. 20.

It will be appreciated that the rails 90 and 95 serve effectively to shorten the travel of the brush handles 45 required to firmly engage them in the holes 80 and 81, thereby effectively shortening the brush box 40. This ability to mount smaller brush handles in holes which appear more suited to larger brushes is an important advantage, since preferably the size of the holes 80 and 81 in the support bridge 70 takes into account the fact that the majority of brush handle sizes are more suited to smaller openings, since the diameters of the tip ends of the brush handles are relatively more similar than the respective wider forward sections of the handles near the ferrules or bristles. Also, the angle of taper from the tip end is generally less in a brush with small bristles than the angle of taper in a brush with large bristles.

Referring also to FIG. 21, the well or recess 76 defined by the support bridge 70 on the outside of the panel 50 permits access to the portion of a brush handle 45 which extends through the support bridge 70, from outside the brush box 40. Thus, even with the brush box 40 closed, the brush handles 45 can be loosened or tightened from outside the brush box 40 by manual engagement of the exposed portion of the brush handles 45 by a thumb or finger 47. Also, when the brush box 40 is open, the well 76 permits a brush to be disengaged from the support bridge 70 and slid out of the brush box 40 with a single finger or thumb, as illustrated in FIG. 21, thereby obviating grasping the brush handle 45 between a finger and thumb and possibly pushing adjacent brushes together if the brush box 40 is full. In this regard, it will be noted that the open end of the panel 50 greatly facilitates insertion and removal of the brushes 41, 42, keeping the bristles 43 clear of any obstruction. It will also be noted that the fact that the lower edges of the inclined walls 71 and 72 of the support bridge 70 are spaced farther apart at the high ends thereof than at the low ends thereof, results in a greater spacing between the holes 81 and 82 as the diameters thereof increase, thereby providing more widely spaced-apart and stable support points for the larger brushes.

It will be appreciated that the support bridge 70*a* and the rails 90*a* and 95*a* of the panel 50*a* operate in exactly the same manner as was just described with respect to the panel 50, the only difference being that the tip ends of the brush handles 45 are disposed at the opposite end of the brush box 40. This location of the support bridges 70 and 70*a* at opposite ends of the brush box 40, as well as their opposite orientation relative to their positions on the panels 50 and 50*a* provides maximum utilization of the space within the brush box 40 when it is closed. Thus, as can best be seen in FIGS. 1, 4 and 16, when the brush box 40 is filled and closed, the large bristle ends of the large brushes nest over the tip ends of the small brushes and vice versa, thereby permitting the maximum number of brushes to be stored within the brush box 40 while maintaining separation therebetween and preventing damage thereto.

While, in the preferred embodiment of the invention, the brush box 40 is integrally molded of plastic, it will be appreciated that other material could be used, and the panels 50 and 50a could be separately constructed and hinged together by suitable means. Furthermore, if desired, panel inserts could be formed in either one of the panels 50 and 50a, as indicated in FIG. 3, for mounting graphic material such as a logo, instructional material or the like.

In a constructional model of the brush box 40, the box has an overall length of approximately 15 inches, with each panel having a width of approximately 4 inches, the height of the box when closed being approximately 2 inches. The holes 80 and 81 preferably range in diameter from approximately 0.25 inch to approximately 0.5 inch. The support bridges 70 and 70a have a height of approximately 0.7 inch at the high end thereof and approximately 0.375 inch at the low end thereof, while the height of the rigid rail 90 slopes from approximately 0.15 inch to approximately 0.125 inch, and the height of the flexible rail 95 slopes from approximately 0.3 inch to approximately 0.2 inch.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A container for artist brushes having elongated tapered handles, said container comprising a pair of elongated panels hingedly interconnected along inner longitudinal edges thereof, two support members respectively disposed on said panels adjacent to opposite ends thereof and extending transversely thereof, each of said support members including two inclined walls spaced apart longitudinally of the corresponding panel and disposed at predetermined angles with respect thereto, said inclined walls of each said support member respectively having like-sized holes therethrough forming a pair of holes having the centers thereof lying along a common axis extending longitudinally of the corresponding panel substantially parallel thereto, each said pair of holes being adapted to receive therethrough a brush handle of a predetermined size until the peripheral edges of the holes of said pair of holes engage the handle firmly to hold it in place with the handle tip disposed at a predetermined location between the corresponding support member and the adjacent end of the corresponding panel, each of said panels including a first rail disposed thereon between said predetermined location and the adjacent end of said panel substantially parallel to the corresponding support member and extending a short distance above the lower ends of the corresponding pair of holes, each of said panels including a second rail disposed thereon between the corresponding first rail and the adjacent end of said panel substantially parallel to said first rail and extending thereabove, each of said first and second rails of each panel being engageable with a brush handle smaller than said predetermined size for elevating the handle and inclining it with respect to said axis to urge the handle into engagement with the peripheral edges of the corresponding pair of holes before the handle extends beyond the adjacent end of the corresponding panel, each of said panels having a side wall extending therefrom substantially normal thereto along the outer longitudinal edge thereof in the direction of the corresponding support member, each of said panels including an end wall extending therefrom substantially normal thereto adjacent to the end thereof nearest the corresponding support member in the direction of and above said side walls, said panels being hingedly movable between a substantially coplanar open configuration wherein associated brushes are insertable through the open ends of said panels and a closed configuration with one of said panels overlying the other substantially parallel thereto and cooperating with said side walls and said end walls to form a closed container, and latch means on said side walls for latching said panels in the closed configuration thereof, whereby different size handles can be held by each of said support members within the confines of said container.

2. The container set forth in claim 1, wherein each of said side walls includes a flange extending upwardly therefrom and terminating at a flat slanted end approximately midway between the ends of said side wall, said slanted ends of said flanges being substantially parallel and overlapping slightly as said panels approach the closed configuration thereof, the hinge interconnection between said panels accommodating relative movement thereof parallel to the longitudinal axes thereof to permit said slanted ends of said flanges to slide into face-to-face abutting relationship with each other for latching said panels in the closed configuration thereof.

3. The container set forth in claim 1, wherein each of said inclined walls of each said support member has a row of holes therethrough decreasing in size from one side of the corresponding panel to the other side thereof with each hole in one inclined wall being substantially identical in size to a corresponding hole in the other inclined wall of that support member to form a pair of holes, the holes of each pair of holes having the centers thereof lying along a common axis extending longitudinally of the corresponding panel substantially parallel thereto.

4. The container set forth in claim 1, wherein each of said inclined walls of each said support member has a row of holes therethrough decreasing in size from one side of the corresponding panel to the other side thereof with each hole in one inclined wall being identical in size to a corresponding hole in the other inclined wall of that support member to form a pair of holes, the holes of each pair of holes having the centers thereof lying along a common axis extending longitudinally of the corresponding panel substantially parallel thereto, the inclined walls of each said support member converging upwardly from the corresponding panel.

5. The container set forth in claim 1, wherein each of said inclined walls of each said support member has a row of holes therethrough decreasing in size from one side of the corresponding panel to the other side thereof with each hole in one inclined wall being substantially identical in size to a corresponding hole in the other inclined wall of that support member to form a pair of holes, the holes of each pair of holes having the centers thereof lying along a common axis extending longitudinally of the corresponding panel substantially parallel thereto, each of the inclined walls of each support member being inclined at the same angle with respect to the corresponding panel and converging upwardly therefrom, each of said inclined walls sloping downwardly from one side of the corresponding panel to the other, whereby the bottom edges of said inclined walls are spaced further apart at said one side of said panel than at the other side thereof.

6. The container set forth in claim 5, wherein each of said first and second rails slopes downwardly from said one side of the corresponding panel to the other side thereof.

7. The container set forth in claim 6, wherein said support member and said rails on one of said panels slopes downwardly from the hinged side to the outer side thereof, while said support member and said rails on the other of said panels slopes downwardly from the outer side to the hinged side thereof, thereby to facilitate nesting of said support members and rails and the associated brushes supported thereby when said panels are disposed in the closed configuration thereof.

8. The container set forth in claim 1, wherein each of said inclined walls has a predetermined thickness with the peripheral edges of each hole defining portions of the surface of a right circular cylinder disposed perpendicular to the corresponding panel, whereby the upper and lower edges of each hole respectively define flexible edge portions resiliently engageable with an associated brush handle extending through said hole.

9. The container set forth in claim 1, wherein each of said panels has an aperture therein beneath the corresponding one of said support members for providing access to a brush handle held in said support member from outside said container.

10. The container set forth in claim 1, wherein said container is integrally formed of a single piece of material.

* * * * *